United States Patent [19]

Weil

[11] 4,013,550

[45] Mar. 22, 1977

[54] MANUFACTURE OF THERMOPLASTIC RESIN BEADS

[75] Inventor: Richard C. Weil, Monroeville, Pa.

[73] Assignee: United States Steel Corporation, Pittsburgh, Pa.

[22] Filed: July 22, 1975

[21] Appl. No.: 598,088

[52] U.S. Cl. ..... 209/9; 209/237

[51] Int. Cl.[2] ..... B03B 1/04

[58] Field of Search ..... 209/1, 2, 3, 4, 9, 233, 209/237; 427/212, 222; 260/2.5 B

[56] References Cited

UNITED STATES PATENTS

| | | | |
|---|---|---|---|
| 2,960,724 | 11/1960 | Sack | 209/233 X |
| 3,012,900 | 12/1961 | Kleinmann | 427/212 |
| 3,161,587 | 12/1964 | Bach | 209/3 |
| 3,236,681 | 2/1966 | Nemphos | 427/222 |
| 3,351,601 | 11/1967 | Blaga | 427/222 X |
| 3,392,007 | 7/1968 | Christoffel | 427/212 X |
| 3,520,833 | 7/1970 | Wright | 260/2.5 B |
| 3,526,605 | 9/1970 | Ingram | 260/2.5 B |
| 3,620,368 | 11/1971 | Comis | 209/3 X |
| 3,756,400 | 9/1973 | Kammori | 209/237 X |
| 3,864,062 | 2/1975 | Feder | 209/9 X |

OTHER PUBLICATIONS

Taggert, 1945, Handbook of Mineral Dressing, (7–38 thru 7–72).

*Primary Examiner*—Robert Halper
*Attorney, Agent, or Firm*—John E. Callaghan

[57] ABSTRACT

In the manufacture of thermoplastic resin particles by polymerization, size classification by screening of polymerized particles at rates from 27 to 69-lbs/hr-ft$^2$ is improved by the use of solid finely divided phosphates and carbonates in amounts of from 500 to 3000 ppm of such salts provided that this amount is above the breakdown point in classification of the particles for such rates of screening.

12 Claims, 1 Drawing Figure

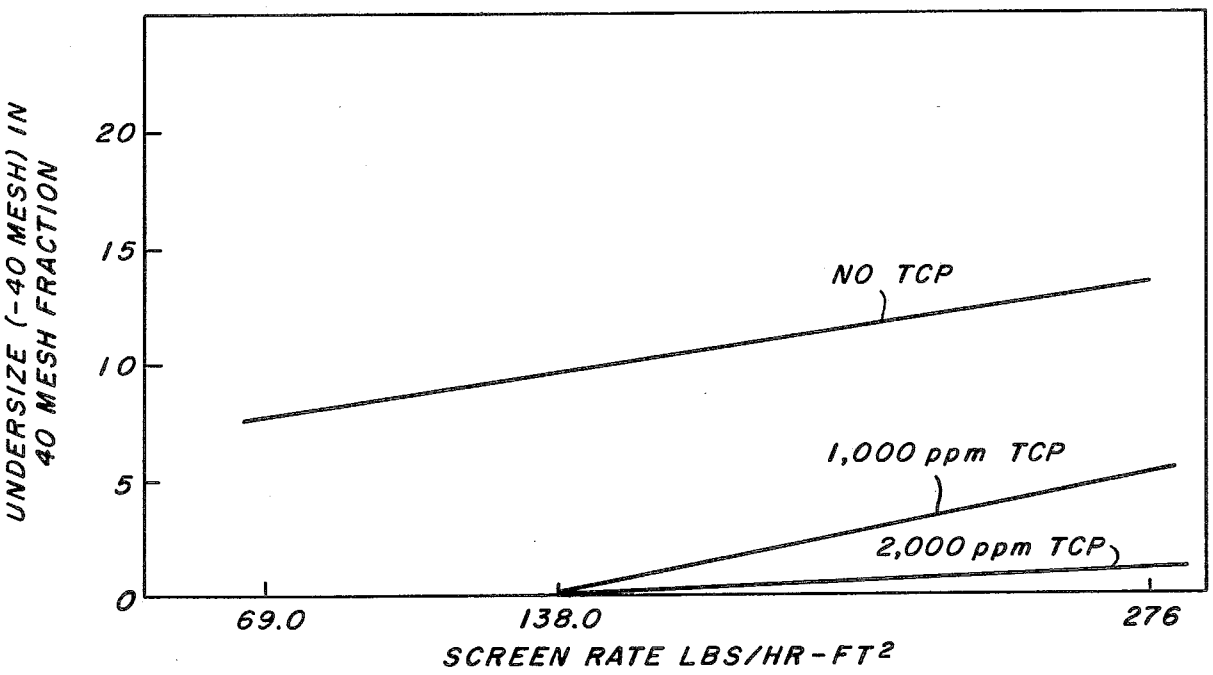
UNDERSIZE (-40 MESH) IN
40 MESH FRACTION
20
15
10
5
0
69.0
138.0
276
SCREEN RATE LBS/HR-FT2
NO TCP
1,000 ppm TCP
2,000 ppm TCP

MANUFACTURE OF THERMOPLASTIC RESIN BEADS

BACKGROUND OF THE INVENTION

Expansible thermoplastic resin particles may be made by first conducting a polymerization and then an impregnation of the resin particles with expansion agent. The impregnated particles are molded into foamed articles by partially filling molds and heating until the resin particles expand, fuse and cool to form the final object. Particularly when the polymer is polystyrene and the impregnated particles are expansible beads of polystyrene, there is great difficulty in satisfactorily conducting the polymerizations to give narrow size distributions of polystyrene particles and to separate these distributions by size classification into predetermined fractions which upon impregnation give beads of uniform size and properties for optimum performance in subsequent molding operations. These same problems also exist when it is desired to obtain selected fractions of polymer beads for subsequent processes such as seed polymerizations.

OBJECTS OF THE INVENTION

Among the objects of this invention are to provide a method of size classification of small particles that is reliable, can operate at high rates, and efficiently separates the particles inot predetermined fractions and where such a method can be practiced under conditions of high electrostatic charge and under ambient atmospheres, without special precautions for humidity control. Furthermore, it is to provide a classification which is sutibale for use in the various forms of classification equipment, including screens, that are ordinarily used in this field. It is also to provide a method in which salts for improved size classification may be salts which are either useful in subsequent processing of such particles or which may be easily removed from the classified fractions of particles. It is also to provide a method for size classification which will allow wider operating conditions for suspension polymerization of thermoplastic resins, specifically polystyrene, in combination with size separation of the polymer products and subsequent utilization of the polymer particles by impregnation of the polymer particles with expansion agents or further polymerization processes. These and other objects are within the sense of my invention as hereafter defined.

DESCRIPTION OF THE INVENTION

In summary, this invention contemplates combining streams of thermoplastic resin particles with at least a minimum amount of an agent comprising solid finely divided phosphate or carbonate salts of alkali or alkaline earth metals and screening the mixture at high rates to recover predetermined size fractions from the overall streams. It is especially suitable for size classification of suspension polymerized resins where there is great difficulty in obtaining close control of particle size in the product of polymerization.

The invention is particularly suited to solid particles in the form of thermoplastic resin particles produced from suspension polymerization. These polymerizations are conducted in an aqueous suspension with monomer, water insoluble polymerization initiator and suspension agent. The high molecular weight polymer is formed as a slurry of finely divided particles with a wide range of size distributions in the aqueous suspension. These particles are recovered by washing and drying. When the dried particles move against each other, this creates electrostatic forces which causes attraction and repulsion among particles so that classification into selected size fractions is diffiicult. This problem is especially severe in the case of suspension polymerized polystyrene particles that are to be made into expandible polystyrene beads, so that this invention is especially effective with these materials.

In general, the thermoplastic resins will have a high molecular weight, greater than 100,000, a low residual monomer, less then 0.01%, and will be in the form of particles in the size range of (±) 120 to (−) 6 mesh, with the bulk of the particles in the range of 60 to 8 mesh. Chemically these thermoplastic resins will be those which generate high electrostatic forces upon agitation and have a high di-electric constant whic tends to prevent dissipation of charge from the particles. These polymers are those containing a majority of polymerized ethylenically unsaturated monomers, such as alkenes and alkenyl aromatics. Polyethylene, polypropylene, polystyrene are typical hydrocarbon polymers. Polyvinylchloride and polyalkylacrylates are typical suspension polymers with pendant polar groups. Polystyrenes having a majority of polymerized syrene units are preferred. In particular, polystyrenes having at least 90% styrene units with other co-monomers in amounts that do not substantially alter the physical and chemical properties of the polymer are useful in this invention. The glassy hard polymers known as crystal polystyrene are commonly used for expandible polystyrene beads. These thermoplastic resins have densities ranging from 0.80 to 1.50. The resins may contain additives such as oils, waxes, dyes, pigments, fillers, antioxidants, flame retardant agents and the like.

Suspension polymerization as well as the properties and structure of crystal polystyrene are well known and described at length in arious texts, including "Textbook of Polymer Science", F. W. Billmeyer, Jr., 2nd Ed., 1971, John Wiley & Sons, Inc., pages 358–359, 506–507. It is a particular advantage of this invention that the efficiency and reliability of the size classification allows recovery of selected size fractions even though the suspension polymerization conditions of time, temperature, concentrations, agitation and suspension agent gives a wide distribution of sizes in the polymer product. It allows wider operating variability in these conditions and avoids the necessity and consequent risk of loss in trying to polymerize so that only optimum size fractions are produced and the necessity to have subsequent polymerizations attempt to reproduce identical size distribution for their product. These are particularly difficult conditions to achieve in the batchwise suspension polymerization of polystyrene, which is widely practiced.

Size classification of the solid particles is conducted by blending dry polymer particles with the finely divided salts until the particles are coated with the salts. The amount of the salt is at least above the breakdown point for the salt for the classifying rate that is to be used. In the blending, it can readily be observed that the finely divided salts will stick to the particles to form a semi-continuous layer on the particle. Blending can be done in conventional equipment such as batch or continuous blenders, e.g., double cone blenders, rubber blenders, and the like. Typical blending equipment is described in "Chemical Engineers' Handbook", 5th Edition, Robert H. Perry and Cecil H. Chilton, McGraw-Hill Book Co., 1973, pages 21–31 to 21–36. Because of their small size, continuous blenders are preferred. After the blending, the mixture of particles and slats is screened to separate the mixture into preselected size fractions.

This separation is performed by screening. Woven fabric or perforated sheets with uniform size openings are used as screens and several screens of various size openings are assembled to form screen packs with a plurality of size ranges. This invention can be used with conventional screening equipment such as gyrating, oscillating, rotating or vibrating screening machines. A description of screening techniques and equipment useful in this invention can be found in "Chemical Engineers' handbook;38 , supra, Chapter 21, pages 21-39 to 21–45. The mixture of particles and salts is agitated while passing through the screens; the screen is designed to permit the particles with sizes smaller than the screen openings to pass (known as fines) while retaining larger materials (known as product). As each successive screen with smaller openings is passed, the "fines" become smaller and ultimately pass through the screening equipment. It is here especially that the effect of the presence of the salts in amounts above the breakdown point can be noted. Without this amount of salt, there is a tendency for smaller particles to pass out with the larger particles and appear as product from a screen. With the phosphate or carbonate, the screen efficiency is increased because the small particles pass on through the screen openings.

In order to achieve the effects of this invention at high rates of screening, the phosphates and carbonates must be used in amounts above at least the breakdown point for the particular rate of screening. It has been observed that the effectivess of the phosphates and carbonates in the classification process depends upon the weight percentage and the rate of screening of the solid polymer particles. When a fraction of resin particles having a predetermined nominal size distribution has been recovered from screening, the efficiency of the screenning can be measured by the relative amounts of undersize material in the sample to the whole sample. This may be expressed as a ratio or as a percentage. The degree of efficiency necessary or desirable for a particular classification of resin particles will vary with the intended subsequent use of the particles. Where the particles are to be used for making expandible polymeric beads or where the particles are to be used as "seed material" in subsequent polymerizations that are adapted for uniform size distribution in the resulting overall polymer product, it can be appreciated that a very high level of efficiency is necessary. Desirably, these fractions will have less than 1% total undersize materials, even as low as 0.1%. In less rigorous applications, the allowable percentage of undersized materials may be as high as 5%. In either case, this invention allows the highest possible rate of screening to attain these efficiencies. The level of salt will vary between 500 and 3,000 ppm of the resin particles used as feed to the screening operation. This rate can be readily determined, as is described in the Examples, but generally involves screen analysis of selected screened fractions as a function of increases amounts of the salt. Thus the FIGURE illustrates the relationship between the rate of classification and the effectiveness of calcium phosphate at various weight percentages. It can be seen that 1,000 ppm of the phosphate represents a level of salt that is very effective at the lower rates but becomes marginally effective at the higher rates so that the breakdown point is a function of screening rate as well as amount of salt.

The comparisons of size distributions of particles from selected screen fractions as measured by analytical screening techniques shows the percentages of materials in each fraction that are not in the nominal size range. As this percentage increases, the efficiency of near size separation among particles is decreasing. In addition to this technique, a companion observation is that the level of salt visibly affects the flow properties in the screened fraction and this accompanies the effect of the salt on size distribution of the screened fraction. When the salt is present in amounts above the breakdown point, a sample from the screened fraction of resin particles will easily flow out of a tilted small container or from a tilted plane surface. The flow of the particles will tend to be uniform and the particles tend to move past each other, in effect they are free-flowing. Where there is insufficient salt or no salt, the flow of particles is irregular and stringy with particles appearing to clamp together, much in the manner of wet resin particles. From this, it appears that the level of the salt affects the stratification of size ranges in a screening device so that the smaller particles are better able to pass through the depth of resin particles to the screen surface and also that the level causes the particles to pass more easily through the exit holes in the screen. In this sense, the salts can be said to have a lubricating effect on the resin particles which is related to the rate of screening. The minimum level of salt can be readily determined from the observation of flow patterns in the resin particles as well as the comparison of measured size distributions.

The salts for the classification of the polymer particles are finely divided solid inorganic salts selected from among the alkali and alkaline earth carbonates, phosphates, complexes thereof and mixtures of the same. The complexes may include insoluble hydroxides, e.g., insoluble calcium phosphates in the form of hydroxy apatites. Typical alkali and alkaline earth salts are the sodium, potassium, calcium, magnesium phosphates and carbonates. These salts are finely divided in that they have a size range of about 10 microns. The range of 5 to 12 microns is particularly convenient. The small sizes will give good contact with the particles of thermoplastic resin and any excess will easily flow through the screen openings and pass out with the fines. Also, these size ranges are available in the hydroxy apatite and magnesium carbonates sold in commerce.

The amount of the salt will be at least above the breakdown point for the rate of classification and will be up to 3,000 ppm. Above this upper level, the salts tend to generate excessive clouds of dust during the classification and do not have an incrementally beneficial effect on the classification. The minimum level can be determined by analytic screening comparisons of classified particles having various levels of salts at several rates of classification. The preferred rates of classification are in the region of 27.6 to 690 lbs/hr-ft$^2$; in particular, the range of 69 to 414 lbs/hr-ft$^2$ are the capacities of available screening machines. The minimum level of salt will also be apparent from inspection of the classification process. There is a smooth flowing appearance to the particles passing through the classification device which indicates a lubricating effect when there is sufficient salt present. If the resin particles are damp, enough salt is used so that the resulting mixture is free flowing. Above the upper limit of salt, there is excessive dust. The phosphate materials are particularly useful in that subsequent recovery of preselected particle sizes may be followed by impregnation with volatile expansion agents in an aqueous suspension. This impregnation, typical details of which are described in U.S. Pat. No. 2,983,692 and U.S. Pat. No. 2,950,261, can be conducted with suspension agents of the finely divided water insoluble inorganic type or of the organic colloid type.

Finely divided water insoluble calcium phosphates, particularly hydroxy apatite, and magnesium carbonates are preferred salts. The mixture of particles and phosphate or carbonate can be classified into desired size fractions and then one or more selected fractions can be directly impregnated in the aqueous suspension with additional suspension agent and expansion agent. Also, the carbonate or phosphate, particularly insoluble calcium phosphates, can be removed from the selected size fractions by acidifying, washing and drying the fraction, as detailed in D'Alelio, U.S. Pat. No. 2,983,692, supra, to give clean dry beads suitable for subsequent impregnation in aqueous suspensions with the use of other organic colloids as suspension agents. In effect, the carbonate or phosphate may be removed from the preselected fraction or left in the preselected fraction, depending upon the most desirable technique for subsequent processing. In all cases, the high efficiency separation of particle sizes amoun the thermoplastic resin particles allows recombination of these fractions to give size fractions that upon impregnation result in expandible resin beads that have good performance in molding.

The screening rates are the amount of material per unit time being classified into preselected size fractions. It has generally been observed that increased rates of screening decrease the efficiency of the classification and decreased rates of screening increase the efficiency of the classification. In the classifying process to which this invention is directed, the presence of the salt in amounts at least above the breakdown point provides improved separation amount the particles and increased rates of screening for a given level of efficiency in the classification. The screening rates in units of pounds per hour depend upon the size, mass and density of the particular resin particles; the type of screening equipment; the desired degree of efficiency in the classification; as well as the size of the equipment. The screening rates in this invention are expressed in units of pounds of resin particles per hour per square foot of open area in the screens, lbs/hr-ft$^2$. These rates are in the range of 26 to 700 lbs/hr-ft$^2$ of particles having a thermoplastic resin which resin has a density of 0.80–1.50. For screening to obtain size fractions in the range of minus 6 (−6) to plus 120 (+120) U.S. sieve sizes, this invention allows the appropriate screening machines to achieve mass flow rates for the thermoplastic resins in the range of from 200 to 5,000 lbs/hr when the salts are present in amounts at least above the breakdown point. By this invention, screening rates are obtained which are from 2 to 10 times the rate practicably achievable when the clssification is performed with insufficient salt.

The type and size of the screens affect the screening rate in that screens with gyratory motion tend to have lower rates of screening but higher efficiency of classification than those having simple rotary motion. Also, the screens with finer wire mesh tend to have more friction during passage of the particles than those with thicker mesh at the same screen opening. The open area of the screen is calculated by subtracting from the total available screen surface the area occupied by the screen wires; the equipment manufacturers usually express the open area as a percentage of the available screen surface.

The polymer particles will have a size range of about minus 6 (−6) to plus 120 (+120) U.S. sieve size. These particles will have approximately a Gaussian distribution of sizes within the range, with the predominate amount in the range of (−8) to (+60) U.S. sieve size. This initial range is to be subdivided into predetermined fractions, in each fraction it is desired that the size indicated contain those sizes of particles with a minimum of smaller sizes. For expandible polystyrene resin beads, the predetermined fractions will be in the range of −8 to +45 U.S. sieve size. Fractions in this range may be selected so that upon recombination, the various types of polymer beads, e.g., beads for impregnation and molding into cup, board or packing articles or beads for further polymerization will have the optimum size ranges for each of these applications.

In the range of (−8) to (+45) U.S. sieve sizes, there may be further preselected fractions, for example, packs of screens having sieve sizes of 16, 18, 20, 25, 30, 35, 40, 45, 50, 60 mesh U.S. sieve will give fractions in the bands between these sizes. As well, bands of size ranges, −20 to +≅, −25 to +30, −30 to +35, −35 to +40, may constitute the predetermined size fractions. In both the fine and coarser predetermined size fractions, the accuracy of screening achieved by the invention is important. Moreover, an initial fraction in the range of minus 8 (−8) to plus 120 (+120) may be subjected to an initial screening to recover a set of first predetermined fractions. Then a portion of the set or an individual fraction may be rescreened. Once the desired fractions have been obtained by screening, either in a single pass or a multiplicity of passes, these may be stored for later combinations to give size ranges of particles suitable for subsequent processing and ultimate use.

It is a benefit of this invention that the solid phosphate and carbonate salts are effective for classifying resin particles under widely varying conditions of humidity and even under conditions conductive to generation of electrostatic forces, e.g., dry atmospheres without special precautions for cntrol of humidity are not necessary.

For impregnation with expansion agent, fractions of polymer beads are combined to give the particular distribution used in molding foam plastic particles. The expansion agent may be hydrocarbon of three to six carbon atoms.

Polystyrene beads with carbonate or phosphate salts may be slurried in water and subjected to impregnation with expansion agents. Hydrocarbons having the requisite shelf stability, diffusity into polystyrene and expansivity ratio may be used. The beads may be suspended with the use of an insoluble calcium phosphate and an anionic surfactant suspension agent and held under elevated temperature and pressure until approximately 5 to 9% by weight of expansion agent is contained in the beads. Thereafter, the impregnated beads are cooled, washed free of suspension agent and dried. Then the beads may be used in conventional EPS molding operations. Pre-expansion followed by molding with steam in a closed mold is one such operation. In the molding, heated beads expand and fuse together; when cooled, the molded article is removed. This molding operation is often automated which requires very uniform properties in impregnated beads. In turn, this requires the particles for impregnation to be of uniform size. The ability of this invention to provide such beads while allowing broad operating conditions in polymerization is noteworthy. Impregnation of polystyrene beads, molding and the relationship of bead size and composition to molding are described in U.S. Pat. No. 3,398,105, as well as "Plastic Foams", Vol. 1, Chapter 1, pps. 2–7, 41–47, c. J. Benning, Wiley Interscience, 1969.

The application of this invention is illustrated by the following examples.

Polystyrene particles are obtained by preparing a suspension of styrene monomer in water with a suspension agent of hydroxy apatite and a surfactant. Benzoyl peroxide catalysts are added and the whole is agitated and polymerized until completion. The slurry of particles is acidified to remove suspension agent, centrifuged, washed and dried. The polymer has physical properties and a composition similar to that of USS 209, a crystal polystyrene sold by USS Chemicals, Division of United States Steel Corporation.

The bending was performed by mixing the polystyrene beads with the salt in a batch blender known as a Drum-Tumbler. The salt was charged to the blender and mixed with the beads until at least a semi-continuous coating of salt was present on the beads.

The coated beads were passed at various rates through a gyrating screening device known as a Ty-Sifter, a product of U.S. Tyler Co. The screen has a nominal diameter of 48 inches, available screening surface of 11.8 ft², and an open area of 7.25 ft². The device was fitted with a screen of stainless steel bolting cloth—48 mesh with an 0.114 mm wire diameter and a screen opening of 0.414 mm (ca. 0.425 mm for U.S. Standard No. 40). It is preferred that each screen used by completely grounded.

Coated beads were fed to the screening device and the fraction having a nominal size of at least 0.414 mm was recovered and tested for actual size distribution in that nominal classification. This is designated as the plus 40 (+40) U.S. sieve fraction. Also, the electrostatic charges present during screening were measured on the beads being fed to the screening device, the beads collected as product in the plus 40 (+40) mesh size, and the beads leaving as minus 40 (−40) mesh material.

Table I

Typical Analysis of Polystyrene Beads Used in Screening Study

| U.S.A. Standard Sieve No. | Sieve Analyses, Wt % |
|---|---|
| 10 | 0.2 |
| 16 | 34.5 |
| 20 | 18.7 |
| 25 | 3.1 |
| 30 | 12.6 |
| 35 | 17.6 |
| 40 | 13.5 |
| 45 | 5.3 |
| 50 | 2.5 |
| pan | 0.9 |

Table II

Effect of TCP on Screening Efficiency at a Screening Feed Rate of 69 lbs/hr-Ft²

| Added TCP, ppm | 0 | 1,000 | 2,000 |
|---|---|---|---|
| U.S.A. Standard Sieve No. | Sieve Analyses of 40 Mesh Material, Wt % | | |
| Plus 40 | 92.2 | 100 | 100 |
| Plus 45 | 2.4 | 0 | 0 |
| Plus 50 | 1.0 | 0 | 0 |
| Plus 60 | 1.0 | 0 | 0 |
| pan | 3.4 | 0 | 0 |

Table III

Effect of TCP on Screening Efficiency at a Screening Feed Rate of 138 lbs/hr-Ft²

| Added TCP, ppm | 0 | 1,000 | 2,000 |
|---|---|---|---|
| U.S.A. Standard Sieve No. | Sieve Analyses of 40 Mesh Material, Wt % | | |
| Plus 40 | 90.1 | 100 | 100 |
| Plus 45 | 2.4 | 0 | 0 |
| Plus 50 | 1.0 | 0 | 0 |
| Plus 60 | 1.0 | 0 | 0 |
| pan | 5.5 | 0 | 0 |

Table IV

Effect of TCP on Screening Efficiency at a Screening Feed Rate of 276 lbs/hr-Ft²

| Added TCP, ppm | 0 | 1,000 | 2,000 |
|---|---|---|---|
| U.S.A. Standard Sieve No. | Sieve Analyses of 40 Mesh Material, Wt % | | |
| Plus 40 | 87.2 | 94.8 | 98.9 |
| Plus 45 | 4.4 | 1.8 | 1.1 |
| Plus 50 | 1.6 | 0.8 | 0 |
| Plus 60 | 1.8 | 0.8 | 0 |
| pan | 5.0 | 1.8 | 0 |

In Table I, there is the overall size distribution of the polystyrene beads fed to the screening devices. This may be the result of a single polymerization or a composite of several polymerization products. In Tables II – IV, there are shown the results of analytically screening the beads having a size greater than 414 microns; also shown are the U.S. Sieve No. fractions which constitute the nominal size range of the material being collected. At a rate of 69 lbs/hr-ft², the presence of hydroxy apatite (shown as TCP) at 1,000 and 2,000 ppm gives no material in the nominal size fraction of less than 40 mesh.

The effect of the level of the phosphate on the flow properties of the collected product was also apparent. At the lower screening rates, with 1,000 ppm of calcium phosphate, small amounts of the product would freely flow from small containers or a tilted hand. At the higher screening rates, with 1,000 ppm of calcium phosphate, the product would tend to clump and its flow would be stringy and irregular.

Equivalent results are also obtained for the screening rate of 138 lbs/hr-ft² shown in Table III. It can be seen that classifying in the absence of the salt with increased rates gives larger fractions of undersized materials in the nominal size range. At a screening rate of 276 lbs/hr-ft², where 1,000 ppm TCP is used, the undersized material in the classification approaches about 5%, as shown in Table IV, thus signifying that the breakdown point for this classifying is being reached. The data of Tables II – IV are shown in the FIGURE as the curves denominated TCP where the ordinate is the percentage of material less than 40 U.S. Sieve No. in the material having a nominal size greater than 40. The feed rate in lbs/hr-ft² is the abscissa. The progressive increase in undersize materials with increasing feed rate and accompanying breakdown point of the classifying salt is clearly shown by the curves.

Table V

Effect of $MgCO_3$ on Screening Efficiency
2000 ppm $MgCO_3$; Nominal Size Classification (−10,+40)

| Screening Rate lbs/hr-Ft² | 69.0 | 138 | 276 |
|---|---|---|---|
| U.S.A. Standard Sieve No. | Analytical Screen Analysis Wt % in Size Range | | |
| 12 | 2.4 | 2.2 | 2.4 |
| 14 | 19.4 | 18.2 | 19.9 |
| 16 | 32.4 | 37.4 | 36.8 |
| 18 | 17.0 | 21.2 | 20.1 |
| 20 | 7.0 | 9.0 | 6.0 |
| 25 | 3.2 | 3.6 | 3.9 |
| 30 | 3.2 | 2.2 | 3.1 |
| 35 | 7.4 | 3.4 | 4.6 |
| 40 | 8.0 | 2.8 | 3.2 |
| −40 | 0 | 0 | 0 |

The results of using magnesium carbonate as the salt are illustrated in Table V. An additional screen having openings of 10 U.S. Sieve No. was used so that the preselected size fraction has a nominal size classification of minus 10 to plus 40 material. Results of analytical screening on these fractions are shown in the table. The near size separations at high screening rates is substantially the same as those at low screening rates which is an important benefit where severl closely sized fractions are to be recovered in a classification process. The effect of the salt during classifying is observed even though high static charges are present during the classification. In classifying beads with magnesium carbonate or hydroxy apatite as the salt in the manner previously described, the electrostatic charges generated by the flowing polystyrene beads were not significantly affected by the salts, but the improved classifying was obtained.

uct of the Simco Co., Inc. ). From these tables it appears that the action of the salt does not dissipate electrostatic charges even though it causes close size separation at high screening rates for the polymeric particles.

This classification of resin particles may employ screening devices operated in series or in parallel or partially in series and partially in parallel. The effects of the invention can be noticed in all of these modes of operation. While a principal use of the invention is to provide resin particles for subsequent conversion into expandible resin materials, it can also be applied to produce mixtures of resin particles and other salts or agents where the salt or agent is available in a size distribution that matches the size range of resin particles that are recovered as products. It is intended that the scope of the invention as set forth in the following claims also include such changes in ingredients, mixing steps and equipment as those skilled in this art would deem the equivalent to the aforedescribed invention.

I claim:

1. In a method for classifying solid thermoplastic resin particles into predetermined fractions of differing sizes which sizes are within the range of minus 6 (−6) to plus 120 (+120) U.S. sieve and recovering the same, wherein said particles are combined with a finely divided inorganic salt selected from the group consisting of alkali and alkaline earth metal carbonates, phosphates, complexes of said carbonates and said phosphates, and mixtures of said carbonates, phosphates and said complexes, followed by dry dynamic screening said mixture to separate said particles into preselected fractions and recovering said fractions; the improvement comprising:

conducting said screening at a rate of from 27 to 690 lbs/hr-ft² of said mixture and the weight ratio of said salt to said particles being at least 500 and up to 3000 ppm of said salts and said weight ratio also being an amount above the breakdown point in classification of the particles for such rate of screening; wherein said pre-selected fractions contain undersized resin particles in an amount no greater than 5% by weight of said pre-selected fractions. At least above the breakdown point for Table VI Effect of TCP on Static-Electricity During Screening

| Bead Feed Rate, lbs/hr-Ft² | 69 | | | 138 | | | 276 | | |
|---|---|---|---|---|---|---|---|---|---|
| Added TCP, ppm | 0 | 1,000 | 2,000 | 0 | 1,000 | 2,000 | 0 | 1,000 | 2,000 |
| | Static Electricity Volts | | | | | | | | |
| Beads in Feed Hopper 40 Mesh Beads | −5,000 | −1,000 | −100 | −2,000 | −6,000 | +1,000 | −1,500 | −1,000 | −400 |
| Leaving Take-Off Chute | +5,000 | +2,000 | +350 | +10,000 | +9,000 | −3,000 | +30,000 | −3,000 | +2,000 |
| 40 Mesh Beads in Product Drum | −5,000 | −8,000 | −10,000 | −20,000 | −1,000 | −1,000 | −20,000 | −10,000 | −1,000 |

Table VII

Effect of $MgCO_3$ on Static Electricity During Screening

| Bead Feed Rate, lbs/hr-Ft² | 69 | | 138 | | 276 | |
|---|---|---|---|---|---|---|
| Added $MgCO_3$, ppm | 0 | 2,000 | 0 | 2,000 | 0 | 2,000 |
| | Static Electricity, Volts | | | | | |
| Beads in Feed Hopper 40 Mesh Beads | −13,000 | −3,000 | −3,000 | +1,000 | −7,000 | +160 |
| Leaving Take-Off Chute | +2,000 | +2,400 | +3,000 | −2,000 | −50,000 | −5,000 |
| 40 Mesh Beads in Product Drum | −30,000 | +7,000 | −6,000 | −18,000 | −60,000 | −6,000 |

This is shown in Tables VI and VII where the charges were measured with an Electrostatic Locator (a prodsuch rate of screening and up to 3,000 ppm of said salts.

2. The method of claim 1 wherein said classifying is performed under ambient conditions of temperature and humidity.

3. The method of claim 1 wherein said particles have a size within the range of minus 6 to plus 120 mesh, U.S. sieve.

4. The method of claim 1 wherein said predetermined size fractions are in the range of minus 10 to plus 45 mesh, U.S. sieve.

5. The method of claim 1 wherein said thermoplastic resin has at least a major proportion of polymerized styrene units.

6. The method of claim 1 wherein said salt is a water insoluble phosphate or carbonate.

7. The method of claim 6 wherein said salt is selected from tricalcium phosphate, hydroxy apatite and magnesium carbonate.

8. The method of claim 1 wherein said salt has a particle diameter in the range of about 5 to 12 microns.

9. The method of claim 1 wherein said rate of screening is at least 69 lbs/hr-ft$^2$ and the amount of said salt is at least 1,000 ppm.

10. The method of claim 9 wherein said rate of screening is at least 138 lbs/hr-ft$^2$ and the amount of said salt is at least 2,000 ppm.

11. The method of claim 1 wherein the amount of said undersized resin particles is an amount no greater than 1% by weight of said preselected fractions.

12. The method of claim 11 wherein the amount of said undersized resin particles is no greater than 0.1% by weight of said preselected fractions.

* * * * *

UNITED STATES PATENT OFFICE

CERTIFICATE OF CORRECTION

Patent No. 4,013,550 Dated March 22, 1977

Inventor(s) Richard C. Weil

It is certified that error appears in the above-identified patent and that said Letters Patent are hereby corrected as shown below:

Column 1, line 29, change "inot" to -- into --

Column 1, line 34, change "sutibale" to -- suitable --

Column 2, line 14, change "(±)" to -- (+) --

Column 2, line 18, change "whic" to -- which --

Column 2, line 39, change "arious" to -- various --

Column 3, line 5, change "slats" to -- salts --.

Column 3, line 16, change "handbook" to -- Handbook --

Column 3, line 16, after "Handbook", delete "38"

UNITED STATES PATENT OFFICE

CERTIFICATE OF CORRECTION

Patent No. 4,013,550 Dated March 22, 1977

Inventor(s) Richard C. Weil Page 2 of 3

It is certified that error appears in the above-identified patent and that said Letters Patent are hereby corrected as shown below:

Column 3, line 64, change "increases" to -- increased --

Column 6, line 31, change "≅" to -- 25 -- (In application Page 12, line 13).

Column 7, line 14, change "c." to -- C. --

Column 7, line 35, change "has" to -- had -- (In

Column 7, line 42, change "by" to -- be -- (In

Column 9, line 33, change "severl" to -- several --

Column 9, line 35, Indent "The" to begin new paragraph

UNITED STATES PATENT OFFICE

CERTIFICATE OF CORRECTION

Patent No. 4,013,550 Dated March 22, 1977

Inventor(s) Richard C. Weil Page 3 of 3

It is certified that error appears in the above-identified patent and that said Letters Patent are hereby corrected as shown below:

Column 10, line 44, claim 1, after "fractions.", delete "At least above the breakdown point for such rate of screening and up to 3,000 ppm of said salts."

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*